United States Patent [19]

Jacomini

[11] 4,217,587

[45] Aug. 12, 1980

[54] ANTENNA BEAM STEERING CONTROLLER

[75] Inventor: Omar J. Jacomini, Severna Park, Md.

[73] Assignee: Westinghouse Electric Corp., Pittsburgh, Pa.

[21] Appl. No.: 933,331

[22] Filed: Aug. 14, 1978

[51] Int. Cl.[2] ..... H01Q 3/26

[52] U.S. Cl. ..... 343/100 SA; 343/854

[58] Field of Search ..... 343/100 SA, 854

[56] References Cited

U.S. PATENT DOCUMENTS

| | | | |
|---|---|---|---|
| 3,454,945 | 7/1969 | Hyltin | 343/100 SA X |
| 3,484,785 | 12/1969 | Sheldon et al. | 343/100 SA |
| 3,737,899 | 6/1973 | Georgopoulos | 343/100 SA X |
| 3,964,065 | 6/1976 | Roberts et al. | 343/100 SA X |
| 4,034,374 | 7/1977 | Kruger | 343/100 SA X |

*Primary Examiner*—T. H. Tubbesing
*Attorney, Agent, or Firm*—W. E. Zitelli

[57] ABSTRACT

An electronically scanned phased array antenna system comprises a phase shift controller corresponding to each antenna array element for individually computing a phase shift value which governs the phase of the signal associated with the corresponding antenna element. The computed phase shift values of all the phase shift controllers effect a phased array on the signals of the antenna elements to point the antenna beam in a desired direction. Each of the phase shift controllers is programmed with a predetermined phase shift value increment for computing a sequence of phase shift values at specified intervals of a predetermined time pattern, each new phase shift value being preferably concurrently computed by the phase shift controllers at the specified time intervals. The phased arrays resulting from each of the newly-computed phase shift values of the sequence render the antenna beam to be scanned in a corresponding sequence of desired directions according to the specified intervals, which may be non-uniformly spaced, in the predetermined time patterns. Each predetermined phase shift value increment correspondly programmed into each phase shift controller may be based on a function of the geometric position of the correspondingly associated antenna element in the antenna array.

9 Claims, 3 Drawing Figures

ANTENNA BEAM STEERING CONTROLLER

BACKGROUND OF THE INVENTION

The present invention relates to electronically scanned type radar antenna systems comprised of a plurality of antenna elements, the signals of which are phase controlled with respect to each other to steer the beam of the antenna in a desired direction, and more particularly to a phase shift controller associated with each of the elements of the antenna for individually computing a phase shift value sequence to govern the phase shift of the corresponding antenna elements in accordance with a predetermined time pattern to increase the speed of antenna beam steering.

Generally electronic scanning type radar antennas are comprised of a plurality of elements which are phase shifted with respect to each other to steer the antenna radar beam. In digitally controlled antenna phased arrays similar to those disclosed in U.S. Pat. Nos. 3,482,244; 3,646,558; and 3,680,109, the phase of each element of the antenna array is controlled by a phase shifter which is usually individually governed by a phase shift controller. Each phase shift controller is provided with a phase shift value which is normally computed in a digital computing device. As a new set of phase shift values associated with the array are loaded into their respective phase shift controllers, the antenna beam is correspondingly steered to a new position. Accordingly, then if a plurality of array sets of phase shift values are computed by the digital computing device in accordance with some predetermined pattern and each new array set is sequentially loaded into the phase shift controllers of the antenna array at some predetermined loading rate, the beam of the antenna may be incrementally steered to scan a portion of space as directed by the precomputed pattern of phase shift value array sets. It is understood that the rate at which the beam is steered across the space is limited primarily by the computation and register loading times of the new phase shift values. In most cases, it is preferred to keep the beam scan increment small to achieve adequate resolution of the portion of space being scanned, however, this tends to increase the frequency of computation and loading combinations for generating each new array set of phase shift values. This may present somewhat of a dilemma should high speed beam steering be additionally specified.

With conventional radar sets which comprise both the transmitter and receiver antennas as an integral unit, the beam of both the transmitter and receiver are normally pointed in the same direction by the very nature of the design. In these conventional radar sets, there is generally no apparent requirement for high speed beam steering and the methods utilized for phase shifting the elements of a phased array antenna, typical of those disclosed in the aforementioned U.S. Pat. Nos. 3,482,244; 3,646,558; and 3,680,109 and that which has been described hereinabove, have been reasonably sufficient in most cases.

Recently, unconventional radar sets, such as a bistatic radar system, have been found to offer certain anti-jamming protection features over conventional radar sets against enemy radar jamming measures. Bistatic radar systems such as the one disclosed in U.S. Pat. No. 3,842,417 utilize different antennas for transmitting and receiving radar energy. Generally, when a transmitter of a conventional radar emits radiation which is possibly detected by the enemy, jamming energies may be transmitted by the enemy in the direction of the transmitter to confuse reception. However, in bistatic radar systems, the receiver is not part of the radar transmitter, but located away from the transmitter and is not influenced by the enemy jamming signals, thereby providing the anti-jamming protection. The bistatic radar receiver can receive radar echo signals from potential targets as long as it is capable of "pulse chasing" the radar pulsed transmissions to establish a target location and track the detected target thereafter. In a typical bistatic radar system, pulsed energy is radiated from the transmitter in a pencil beam at a predetermined time and in a prespecified direction in space. The pulsed energy follows the prespecified beam direction at the speed of light. To "pulse chase", the beam of the receiver of the bistatic radar system must be directed to follow the pulse of energy from the transmitter as it is radiated out in space in the pencil beam at the speed of light so that any reflected energy from a target located within the pencil beam of the transmitter will be received within the beam of the receiver. For this reason, the beam scanning speed of a bistatic radar receiver, in some cases, must be maintained close to the speed of light.

Bistatic radar receivers are usually electronically scanned phased arrays similar to those disclosed in U.S. Pat. Nos. 3,825,928 and 3,978,482. The limiting factor in the receiver's capability of "pulse chasing" is primarily the speed at which the digital computing device can calculate each new array set of phase shifting values for the phase shift controllers which govern the phase of the elements of the receiver array to incrementally set the next beam scan angle or angle direction jump. Another time problem associated with "pulse chasing" is related to the loading of all the registers of the phase shift controllers with the next array set of phase shifting values prior to incrementing to the next angle in the beam scan of the receiver. Attempts to achieve incremental phase stepping at megahertz rates have been expensive to achieve using the conventional beam steering techniques described supra. The present invention disclosed hereinbelow offers unconventional techniques for calculating the phase shifting values of each of the elements of the receiver's phase array to provide low cost, very rapid non-uniform beam scan capability for such high speed beam steering applications like "pulse chasing" for target location detection in bistatic radar sets, for example.

SUMMARY OF THE INVENTION

The broad principles of the present invention are described in connection with an electronically scanned phased array antenna system which includes an array of antenna elements and a phase shifter corresponding to each antenna element for adjusting the phase of the signal associated with said corresponding antenna element. Each phase shifter is governed by a computed phase shift value, the plurality of which effecting a phased array on the signals of the antenna elements for pointing the antenna beam in a desired direction. In accordance with the present invention, the antenna system further comprises a phase shift controller corresponding to each phase shifter for individually computing the phase shift value which governs the corresponding phase shifter, each phase shifter being preprogrammed with a predetermined phase shift value increment to compute a sequence of phase shift values in accordance with a predetermined time pattern. The resulting sequence of phased arrays render the antenna beam scan in a corresponding sequence of desired directions. Accordingly, the invention principles may be embodied in either a transmitting or receiving radar antenna system.

More specifically, each new phase shift value of the sequence of phase shift values corresponding to each phase shift controller is computed by adding the predetermined phase shift increment programmed therein to a present phase shift value corresponding thereto at intervals specified by the predetermined time pattern associated therewith. These phased array sequences of new phase shift values which are computed, preferably concurrently, by the plurality of phase shift controllers at the intervals, which may be non-uniformly spaced, in the predetermined time patterns cause the antenna beam to be incremently scanned in a direction specified thereby. Each phase shift value increment programmed in each phase shift controller may be based on a function of the geometric position of the corresponding element in the antenna array.

DESCRIPTION OF THE PREFERRED EMBODIMENT

Figure 1:
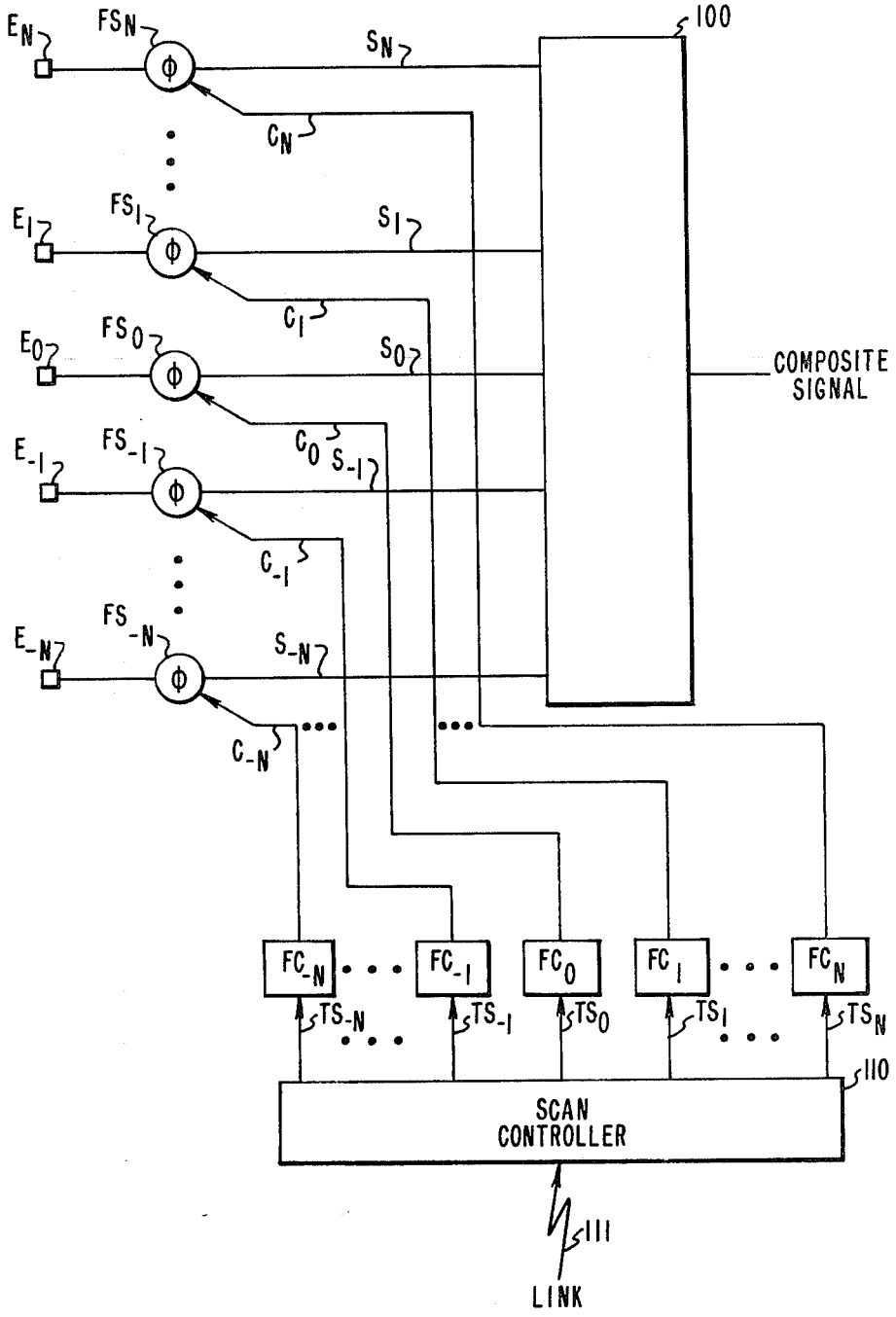
FIG. 1 is a schematic functional block diagram of a portion of an electronically scanned phased array antenna embodying the broad principles of the present invention.

The broad principles of the present invention may be described in connection with an electronically scanned phase array antenna, a functional portion of which is shown simply in FIG. 1. The embodiment of FIG. 1 depicts partially an antenna of a one-dimensional phased array having a plurality of elements which may be either radiating elements in which case the antenna is utilized for transmitting purposes or receiving elements in which case the antenna is utilized for receiving purposes. The antenna elements are denoted as $E_N, \ldots, E_1, E_0, E_{-1}, \ldots, E_{-N}$ and may be proportionately aligned in geometric position along a linear axis in a manner well known to those skilled in the pertinent art. Coupled to each of the antenna elements may be a conventional phase shifter ($FS_N, \ldots, FS_1, FS_0, FS_{-1} \ldots, FS_{-N}$) which may be of a linear analog type or digital type, the latter being preferred, for the purposes of introducing phase shifts in the signals applied thereto.

For the case in which the antenna is a receiver, received signals $S_N, \ldots, S_1, S_0, S_{-1}, \ldots, S_{-N}$ correspondingly influenced by the phase shifters $FS_N, \ldots, FS_1, FS_0, FS_{-1}, \ldots, FS_{-N}$ may be combined in a conventional fashion in a combiner 100 which may be any one of the types of combiners standardly used in radar receivers. Likewise, for the case in which the antenna may be used for transmitting purposes, the transmitted signals $S_N, \ldots, S_1, S_0, S_{-1}, \ldots, S_{-N}$ correspondingly influenced by the phase shifters $FS_N, \ldots, FS_1, FS_0, FS_{-1}, \ldots, FS_{-N}$ may be split by a conventional phase splitter 100 which may also be any one of the types standardly used in radar transmitter applications. In either application, each phase shifter $FS_i$ adjusts the phase of the signal $S_i$ coupled thereto as governed by a signal $C_i$ which may be representative of a desired phase shift value. The plurality of desired phase shift values or signal lines $C_N, \ldots, C_1, C_0, C_{-1}, \ldots, C_{-N}$ correspondingly govern the phase shifters $FS_N, \ldots, FS_1, FS_0, FS_{-1}, \ldots, FS_{-N}$ to effect a phased array of the respective signals $S_N, \ldots, S_1, S_0, S_{-1}, \ldots, S_{-N}$ of the antenna elements for pointing the antenna beam in a desired direction. A typical electronically scanned phased array antenna is disclosed in U.S. Pat. No. 3,999,182 entitled "Phased Array Antenna With Coarse/Fine Electronic Scanning For Ultra-Low Beam Granularity" issued to Moeller et al. on Dec. 21, 1976 which is incorporated by reference herein for a more complete understanding of the details of such a typical antenna system.

In accordance with the broad principles of the invention, the phase shifter governing signals $C_N, \ldots, C_1, C_0, C_{-1}, \ldots C_{-N}$ are individually computed in a respectively corresponding set of phase shift controllers $FC_N, \ldots, FC_1, FC_0, FC_{-1}, \ldots, FC_{-N}$. Each phase shift controller $FC_i$ may be preprogrammed with a correspondingly associated predetermined phase shift value increment which is used by the phase shift controller to compute a sequence of phase shift values in accordance with a signal representative of a predetermined time pattern conducted over signal line $TS_i$ which is coupled thereto. The timing signals which may be commonly or individually connected over lines $TS_N, \ldots, TS_1, TS_0, TS_{-1}, \ldots, TS_{-N}$ may be derived by a conventional scan controller 110 to correspondingly control the time at which computations are sequentially executed in their corresponding phase shift controllers. In the case in which the antenna system is utilized as a radar receiver as part of a bistatic radar system, the scan controller 110 may be linked over line 111 with the bistatic radar transmitter (not shown) to receive information concerning direction of transmission beam and times at which pulsed energy is being transmitted, for example, and derive the various timing patterns accordingly. The above-referenced U.S. Pat. No. 3,999,182 may be also used for obtaining knowledge of further details of operation of a typical scan controller.

In operation, the scan controller 110 conventionally determines the scanned beam pattern of the antenna, as depicted in FIG. 1, from information received from preselected sources such as a bistatic radar transmitter, for example. Timing signals are derived and coupled either commonly or individually to the phase shift controllers $FC_N, \ldots, FC_1, FC_0, FC_{-1}, \ldots, FC_{-N}$ respectively over signal lines $TS_N, \ldots, TS_1, TS_0, TS_{-1}, \ldots, TS_{-N}$. These timing signals may be each comprised of a stream of binary signals, for example, and each corresponding phase shift controller $FC_i$ may be programmed to either do nothing, if a binary zero signal is present on the signal line $TS_i$, or execute a computation of a new phase shift value in the sequence of phase shift values which the controller $FC_i$ is capable of computing, if a binary one signal is present on the signal line $TS_i$. In this manner, at prespecified intervals of the timing signals, which are preferably synchronized, new phase shift signals are computed by the corresponding phase shift controllers to govern the corresponding phase shifters to effect an incremental beam scan which may be comprised of a sequence of small steps of desired directions, say on the order of 1/12 the beam width, for example.

For the application in which the antenna system described in connection with FIG. 1 is being utilized as a bistatic radar receiver, each phase shift controller $FC_i$ may be programmed with an appropriate phase shift value increment which is used by the $FC_i$ to compute a sequence of phase shift values. Accordingly, the phase of arrays associated with each new phase shift value of each computed sequence cause the receiving beam of the antenna to be steered along a specified beam direction of the associated bistatic transmitter. Each new phase shift value of each of the phased arrays of the sequence may be concurrently computed by the phase shift controllers $FC_N, \ldots, FC_1, FC_0, FC_{-1}, \ldots FC_{-N}$, upon command, at specified intervals of the corresponding time patterns $TS_N, \ldots, TS_1, TS_0, TS_{-1}, \ldots, TS_{-N}$ which are preferably synchronized. The time pattern $TS_i$ derived by the scan controller 110 determines the speed at which each synchronized phase shift value sequence is computed which relates to the speed at which the beam of the receiver scans along the specified transmitted beam path.

If the scan controller 110 is directed to initialize the direction of the receiver beam scan at the associated bistatic transmitter synchronous to the time at which a pulse of energy is transmitted and to render a time pattern which governs the receiver beam scan at a speed approximately proportional to the speed of light, the scan of the receiver beam may be capable of "chasing" the pulsed energy of the transmitter in the prespecified transmitted beam direction and receiving the radar echoes from a target which may be located in the path of the transmitted beam, thereby providing for detection of the location of a potential target in space.

A suitable embodiment of the phase shift controller $FC_i$ described in connection with FIG. 1 which is typical of all the phase shift controllers $FC_N, \ldots, FC_1, FC_0, FC_{-1}, \ldots FC_{-N}$ is exhibited in the functional block schematic of FIG. 2. At least one storage register 120 is disposed within $FC_i$ and may be preprogrammed to store a predetermined phase shift value increment, which, in many cases, may be determined as a function of the geometric position of the antenna element $E_i$ in the antenna array which corresponds to the phase shifter $FS_i$ being governed by the phase shift controller $FC_i$. The at least one storage register 120 may be either a read-only memory (ROM), a random access memory (RAM), or a set of jumpers having a capacity of binary bits commensurate with the desired resolution of beam scan, commonly measured with respect to the incremental beam scan step which may be, in some applications, on the order of 8 degrees. The output of register 120 and the signal line $C_i$ are coupled to the two inputs of a conventional adder function 130 which adds the phase shift increment value of register 120 to the present phase shift value on signal $C_i$ to generate a signal over line 132 representative of their sum which may be the new phase shift value. A conventional gate function 136 couples the result of the summation 132 to one of two registers 134 or 135 as commanded by a gate control signal over signal line 138. A second conventional gate function 140 couples either the contents of register 134 or 135 to the signal line $C_i$ as governed by a gate control signal 142. The gate control signals 138 and 142 may be generated by a gate control sequencer 144 which is activated by the timing signal $TS_i$ having a predetermined time pattern derived by the scan controller 110 (see FIG. 1). For the purposes of this embodiment, the registers 120, 134 and 135, the adder function 130, and the gate functions 136 and 140 may all be of the digital variety type generally comprised of well-known digital circuit elements such as serial or parallel operated adders, storage registers and digital gates, all having appropriate binary bit storage capacities. The gate control sequencer 144 may be comprised of a digital flip-flop circuit, for example, operative to generate the gate control signals 138 and 142.

Figure 2:
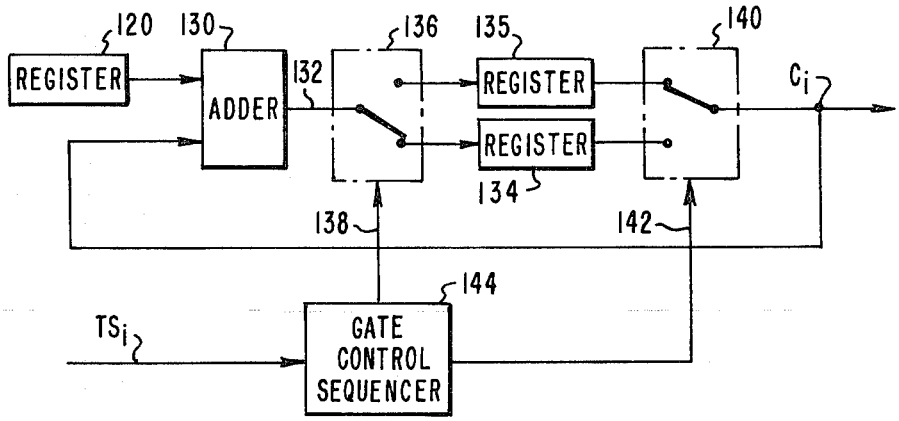
FIG. 2 is a schematic functional block diagram of a phase shift controller suitable for use in the embodiment of FIG. 1.
Figure 3:
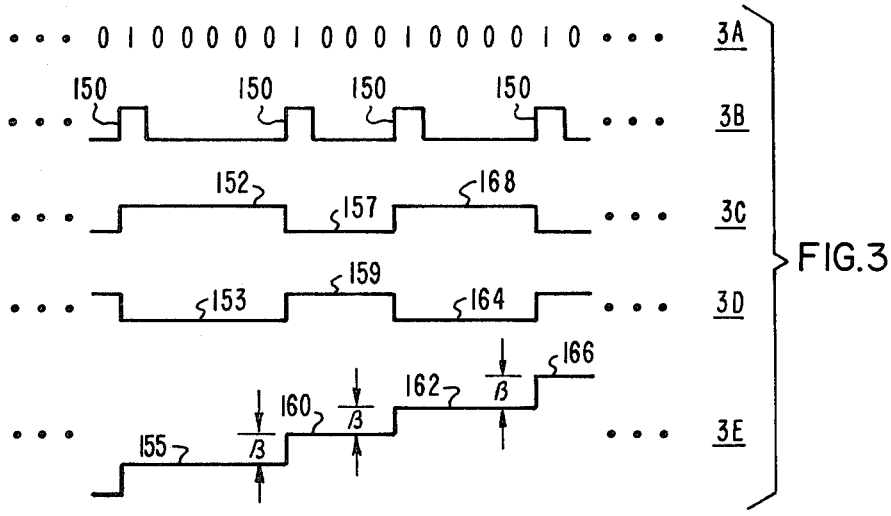
FIG. 3 exhibits waveforms depicting exemplary operation of the phase shift controller embodiment of FIG. 2.

The waveforms depicted in FIG. 3 will be used to facilitate the description of operation of the phase shift controller $FC_i$ exhibited in FIG. 2. As noted above, the timing signals over a typical signal line $TS_i$ may be comprised of a stream of binary ones and zeros similar to that shown in waveform 3A. This stream of ones and zeros may be represented by a train of pulses, which may be, at times, non-uniformly spaced in time in which each pulse is concurrent with a binary one signal (see waveform 3B).

For one example of operation, the gate control sequencer 144 may be responsive to the leading edge 150 of each pulse of the pulse train conducted over signal line $TS_i$ to alternately change the digital status of the gate control signals 138 and 142 which are exhibited in waveforms 3C and 3D, respectively. The digital status of the control signals 138 and 142 govern the position of their respective gates 136 and 140. For example, when the control signal 138 is a "one" and signal 142 is a "zero" as shown at 152 and 153 of waveforms 3C and 3D, respectively, the gate 136 is positioned such that the result of the summation of adder 130 is conducted to register 134 and the present phase shift signal existing on signal line $C_i$ which may be at the level 155 shown in the waveform 3E is conducted from register 135. The adder 130 at this same point in time responds by adding the most recently updated phase shift signal $C_i$ denoted at level 155 of waveform 3E with the predetermined phase shift value increment which may be denoted as $\beta$ and outputting the result over signal line 132 which is conducted to register 134 for storage.

At the next pulse leading edge 150 of $TS_i$, the digital status of control signals 138 and 142 are governed to alternate as shown at 157 and 159, respectively, in waveforms 3C and 3D. Consequently, the new phase shift value $C_i$, denoted at level 160 of waveform 3E, is conducted from register 134 as selected by the gate 140 which is controlled by the digital one status (159) of signal 142 (see waveform 3D). The adder 130 again responds by adding this most recently updated phase shift value $C_i$ denoted at level 160 of waveform 3E with the predetermined increment $\beta$. The sum is now conducted over signal line 132 to register 135 as guided by gate 136 whose position is controlled by the digital status (157) of the gate control signal 138 (see waveform 3C).

At the next successive pulse 150 of waveform 3B, level 162 of waveform 3E becomes the present phase shift value $C_i$ conducted from register 135 as commanded by the digital status at 164 of the gate control signal 142 (see 3D) and the new phase shift value at level 166 of waveform 3E which is the computed sum of the adder 130 is conducted to register 134 as commanded by the digital status at 168 of the gate control signal 134 as shown in the waveform 3C. Similarly, at all subsequent pulse intervals 150, the phase shift value signal $C_i$ is incremented by the predetermined phase shift value increment $\beta$ preprogrammed in register 120 to effect a sequence of phase shift values similar to that shown in waveform 3E at 155, 160, 162 and 166.

In summary, each phase shift value in the computed sequence of the plurality of phase shift controllers govern their correspondingly associated phase shifters to influence the phase of the signals coupled to the element of the antenna to produce a phased array to point the beam in a desired direction. Each new phase shift value of the plurality of phase shift controllers is computed in time, preferably concurrent with each other, in accordance with the pulsed interval time pattern of the scan controller. The phased arrays produced thereby govern the beam of the antenna to be incrementally swept in the plane designated by the linear array of the antenna over a desired angle normally on the order of 60°. The initial beam sweep angle and beam sweep increments may be specified by an array of predetermined phase shift value and increments which are programmed into their corresponding phase shift controllers. The rate of incrementing the beam steps, which may be achieved at megahertz levels, is regulated by the computing time patterns corresponding to each phase shift controller. Each of the time patterns may be comprised of a control stream of binary ones and zeros to provide a completely flexible and rapid electronic beam scan capability.

While the embodiment has been described in connection with an antenna having a linear array of elements, as shown in FIG. 1, it is understood by all those skilled in the pertinent art that the antenna array may be extended to a two-dimensional antenna array without deviating from the principles of the present invention. Furthermore, while the embodiment described in connection with FIG. 2 is suitable for describing the principles of applicant's invention as related to a phase shift controller, the scope of the present invention should not be limited in any way by this embodiment, rather applicant's invention should be construed in light of the claims here to follow:

I claim:

1. In an electronically scanned phased array antenna system including an array of antenna elements and a phase shifter corresponding to each antenna element in said array for adjusting the phase of the signal associated with said corresponding antenna element, said each phase shifter being governed by a computed phase shift value, the plurality of which effecting a phased array on the signals of the antenna elements for pointing the antenna beam in a desired direction;

a phase shift controller corresponding to each phase shifter for individually computing said phase shift value which governs said corresponding phase shifter, each phase shift controller being preprogrammed with a predetermined phase shift value increment to compute a sequence of phase shift values in accordance with a predetermined time pattern, thereby governing the scan of the antenna beam in a corresponding sequence of desired directions.

2. An antenna system in accordance with claim 1 wherein the system is for transmitting radar signals, wherein the antenna elements are radiating elements, and wherein the phase shift controllers govern the scan of the radiating radar beam of the transmitting antenna.

3. An antenna system in accordance with claim 2 wherein the phase shifters are digital phase shifters; and wherein each phase shift value of the sequence of phase shift values is incrementally computed in a digital form in accordance with a discrete time pattern.

4. An antenna system in accordance with claim 3 wherein each phase shift controller comprises:

a first register preprogrammed to store a signal representative of the phase shift value increment;

a second register capable of storing, upon command, each present phase shift value;

an adder for adding the content of said first and second registers to compute a new phase shift value;

a third register for storing, upon command, each new phase shift value which governs the corresponding phase shifter associated therewith; and a controlling means for commanding the storage update of said second and third registers in accordance with the intervals specified by the predetermined time pattern.

5. An antenna system in accordance with claim 1 wherein the system is for receiving radar signals, wherein the antenna elements are receiving elements, and wherein the phase shift controllers govern the scan of the receiving radar beam of the transmitting antenna.

6. An antenna system in accordance with claim 2 or 5 wherein each phase shift controller includes means for generating signals representative of prespecified intervals of the predetermined time patterns associated with the respective phase shift controller, and means governed by said generated signals for computing a new phase shift value in the sequence of phase shift values of the respective phase shift controller by adding the predetermined phase shift value increment programmed therein to a present phase shift value corresponding thereto.

7. An antenna system in accordance with claim 6 wherein the antenna array is an area array; and wherein the predetermined phase shift value increment which is preprogrammed in each phase shift controller is based on a function of the geometric position of its corresponding antenna element in the antenna area array.

8. An antenna system in accordance with claim 6 wherein the antenna array is a linear array and wherein each phase shift value increment preprogrammed in each phase shift controller is proportional to the position of its corresponding antenna element in said linear array.

9. An antenna system in accordance with claim 6 wherein the means for generating signals further comprises means for generating signals of prespecified intervals which are non-uniformly spaced in the predetermined time patterns.

* * * * *